US010112793B2

(12) United States Patent
Nunota et al.

(10) Patent No.: US 10,112,793 B2
(45) Date of Patent: Oct. 30, 2018

(54) OPENING METHOD AND DEVICE THEREOF

(71) Applicant: Nippon Steel & Sumitomo Metal Corporation, Tokyo (JP)

(72) Inventors: Yoshiaki Nunota, Tokyo (JP); Takahiro Fujioka, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 528 days.

(21) Appl. No.: 14/532,602

(22) Filed: Nov. 4, 2014

(65) Prior Publication Data

US 2015/0121985 A1 May 7, 2015

(30) Foreign Application Priority Data

Nov. 6, 2013 (JP) ..... 2013-230382

(51) Int. Cl.
*B65H 16/08* (2006.01)
*B65H 16/10* (2006.01)
*B65H 19/10* (2006.01)

(52) U.S. Cl.
CPC ..... *B65H 16/08* (2013.01); *B65H 16/106* (2013.01); *B65H 19/105* (2013.01); (Continued)

(58) Field of Classification Search
CPC ..... B65H 37/00; B65H 16/08; H04J 1/02
(Continued)

(56) References Cited

U.S. PATENT DOCUMENTS 4,549,700 A * 10/1985 Ganseuer ..... B21C 47/00 242/527
2015/0121985 A1* 5/2015 Nunota ..... B65H 16/08 72/324

FOREIGN PATENT DOCUMENTS

JP 59-174218 10/1984
JP 60-000151 1/1985
(Continued)

OTHER PUBLICATIONS

Japanese Office Action dated Mar. 28, 2017, issued in corresponding Japanese Patent Application No. 2013-230382 with English translation.

*Primary Examiner* — Scott R Kastler
(74) *Attorney, Agent, or Firm* — Birch, Stewart, Kolasch & Birch, LLP

(57) ABSTRACT

An opening radial dimension is set as a radial direction permissible dimension K of the metal coil as expressed by the following equation or lower.

$$K = \frac{Yp \times Z}{2EI} R^2(\Theta - \sin\Theta\cos\Theta)$$

Wherein: K is a radial direction permissible dimension at the load action point position in mm; Yp is a yield stress of the metal sheet, in kgf/mm$^2$; Z is a section modulus of the metal sheet, in mm$^3$; R=(a metal coil radius r)−½(the plate thickness t of the metal sheet), in mm; E is a Young's modulus of the metal sheet, in kgf/mm$^2$; I is a second moment of area of the metal sheet in mm$^4$; and Θ is an angle in radians about the axis of the metal coil from the load action point to the nearest restraining roll along a rewind direction of the metal coil.

16 Claims, 11 Drawing Sheets

(52) U.S. Cl.
CPC ..... *B65H 2301/51512* (2013.01); *B65H 2301/51531* (2013.01); *B65H 2404/61* (2013.01); *B65H 2405/312* (2013.01); *B65H 2701/173* (2013.01)

(58) Field of Classification Search
USPC ..... 72/324
See application file for complete search history.

(56) References Cited

FOREIGN PATENT DOCUMENTS

| | | | |
|---|---|---|---|
| JP | 63-084727 | | 4/1988 |
| JP | 04-008127 | | 2/1992 |
| JP | 6-82543 | U | 11/1994 |
| JP | 9-225527 | A | 9/1997 |
| JP | 2013-514186 | | 4/2013 |

* cited by examiner

OPENING METHOD AND DEVICE THEREOF

CROSS-REFERENCE TO RELATED APPLICATION

This application is based on and claims priority under 35 USC 119 from Japanese Patent Application No. 2013-230382 filed on Nov. 6, 2013, the disclosure of which is incorporated by reference herein.

BACKGROUND

Technical Field

The present invention relates to an opening method and device thereof.

Related Art

An opening device is being implemented in which, when collecting test samples from metal coils of wound metal sheet, an opener board is placed in contacted with the entire width of the outer peripheral surface of a metal coil, the leading end portion of the metal coil is opened (unwound; separated from the coil), and a sample is cut with a cutting device (see, for example, Japanese Patent Application Laid-Open (JP-A) No. S59-174218).

The opener board is a rectangular shaped board, and the leading end portion of the metal sheet configuring the metal coil is lifted up onto the opener board by placing the leading end of the opener board in contact with the outer peripheral surface of the metal coil, and rotating the metal coil. The metal sheet is pulled out along the opener board. A test sample is collected by cutting the metal sheet pulled out from the metal coil over the opener board in this manner using gas or a blade.

However, when opening the metal coil using the opener board, the metal sheet that was wound curved into the metal coil is straightened out along the opener board. As a result, a high bending load acts on the metal sheet remaining in the metal coil, plastic deformation occurs, and the metal sheet does not return to its original shape after rewinding. There is accordingly an issue that plastic deformation occurs at the leading end portion of the metal coil when strapping, with the possibility of slackness occurring.

SUMMARY

In consideration of the above circumstances, an object of the present invention is to provide an opening method that enables plastic deformation to be suppressed from occurring in an opened metal coil, and a device thereof.

A first aspect of the present invention provides an opening method including restraining an outer peripheral surface of a metal coil of a wound metal sheet with a plurality of restraining rolls; disposing an opening blade body so as to satisfy the following Equation (1) and Equation (2), and contacting a blade tip of the opening blade body onto the outer peripheral surface of the metal coil; and rotating the metal coil in an opposite direction to a take-up direction of the metal coil, separating a leading end portion of the metal sheet from the metal coil using the opening blade body, and supporting an inner peripheral surface of the metal sheet using the opening blade body with the leading end portion of the metal sheet in a free state:

$$K = \frac{Yp \times Z}{2EI} R^2(\Theta - \sin\Theta\cos\Theta) \quad \text{[Equation (1)]}$$

-continued $$U \leq K \quad \text{[Equation (2)]}$$

wherein:

U is an opening radial direction dimension, from a load action point at which the inner peripheral surface of the metal sheet is supported by the opening blade body, to the outer peripheral surface of the metal coil, in mm;

K is a radial direction permissible dimension at the load action point position, from the inner peripheral surface of the metal sheet to the outer peripheral surface of the metal coil, in mm;

Yp is a yield stress of the metal sheet, in kgf/mm$^2$;

Z is a section modulus of the metal sheet (=(⅙)bt$^2$), in mm$^3$, wherein b is a width of the metal sheet, in mm, and t is a plate thickness of the metal sheet, in mm;

R is a metal coil radius r from which one-half of the plate thickness t of the metal sheet has been subtracted (r−(½) t), in mm;

E is a Young's modulus of the metal sheet, in kgf/mm$^2$;

I is a second moment of area of the metal sheet, in mm$^4$; and

Θ is an angle in radians about an axis of the metal coil from the load action point to a portion restrained by a nearest restraining roll of the restraining rolls along a rewind direction of the metal coil.

A second aspect of the present invention provides an opening device including: a cradle mechanism including a plurality of restraining rolls that rotatably restrain an outer peripheral surface of a metal coil of a wound metal sheet; a drive section that drives the cradle mechanism so that the metal coil is rotated in a take-up direction or an opposite direction to the take-up direction; and an opening blade body disposed so as to contact a blade tip of the opening blade body onto an outer peripheral surface of the metal coil so as to satisfy the following Equation (3) and Equation (4):

$$K = \frac{Yp \times Z}{2EI} R^2(\Theta - \sin\Theta\cos\Theta) \quad \text{[Equation (3)]}$$

$$U \leq K \quad \text{[Equation (4)]}$$

wherein:

U is an opening radial direction dimension, from a load action point at which the inner peripheral surface of the metal sheet is supported by the opening blade body, to the outer peripheral surface of the metal coil, in mm;

K is a radial direction permissible dimension at the load action point position, from an inner peripheral surface of the metal sheet to the outer peripheral surface of the metal coil, in mm;

Yp is a yield stress of the metal sheet, in kgf/mm$^2$;

Z is a section modulus of the metal sheet (=(⅙)bt$^2$), in mm$^3$, wherein b is a width of the metal sheet, in mm, and t is a plate thickness of the metal sheet, in mm;

R is a metal coil radius r from which one-half of the plate thickness t of the metal sheet has been subtracted (r−(½) t), in mm;

E is a Young's modulus of the metal sheet, in kgf/mm$^2$;

I is a second moment of area of the metal sheet, in mm$^4$; and

Θ is an angle in radians about an axis of the metal coil from the load action point to a portion restrained by a nearest restraining roll of the restraining rolls along a rewind direction of the metal coil.

DETAILED DESCRIPTION

Explanation next follows regarding a coil sample collection device 10 serving as an opening device according to an exemplary embodiment of the present invention, with reference to FIG. 1 to FIG. 7E. In each of the diagrams, the arrow X direction is the axial direction of a metal coil W mounted to cradle rolls 28, and is sometimes referred to below as the "X direction". The arrow Y direction is a direction parallel to the floor and orthogonal to the arrow X direction, and is sometimes referred to below as the "Y direction". Moreover, the arrow Z direction is the height direction, and is sometimes referred to below as the "Z direction".

Figure 1:
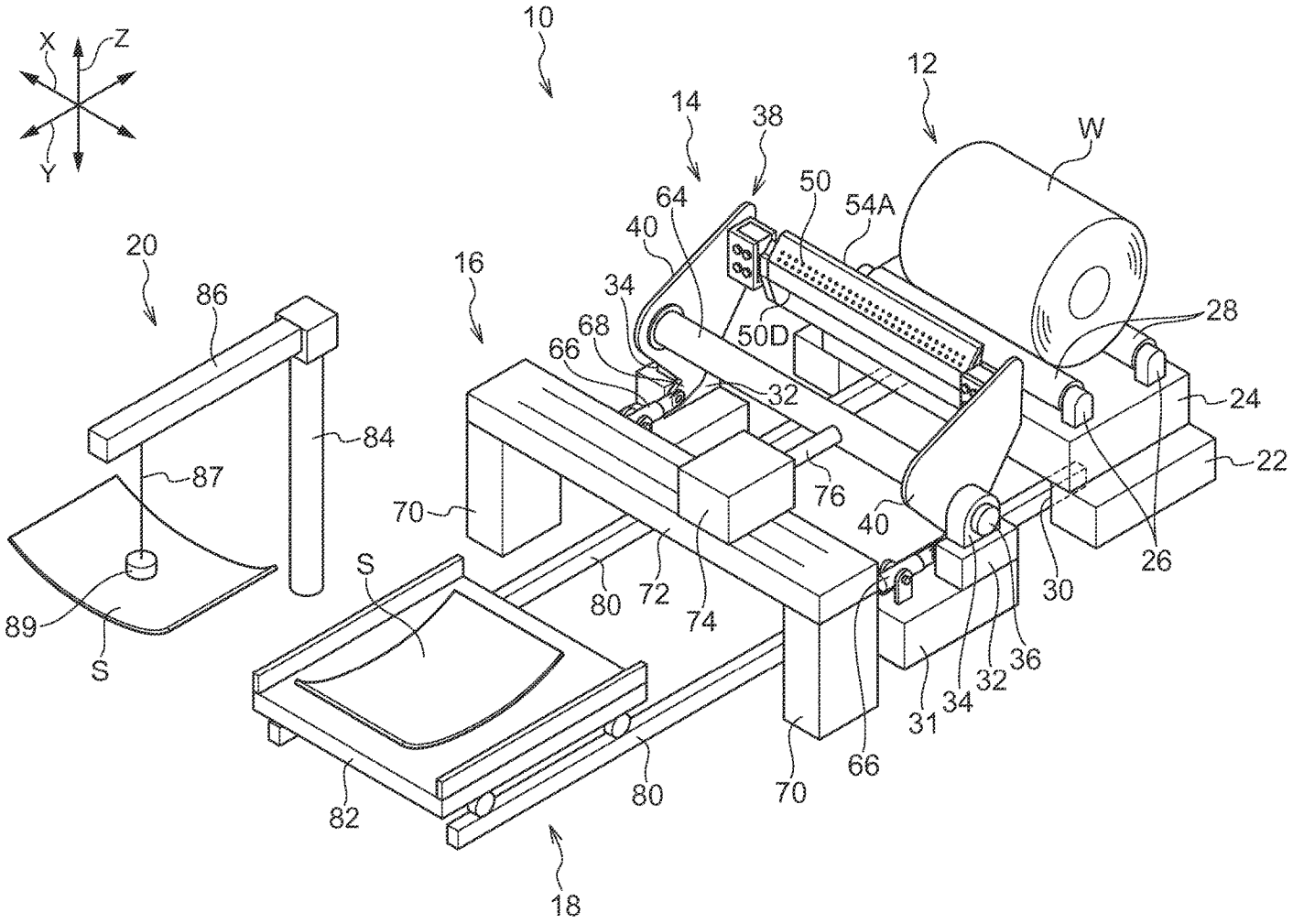
FIG. 1 is a perspective view illustrating a schematic configuration of a coil sample collection device in which the opening method according to an exemplary embodiment of the present invention is applied.
Figure 2:
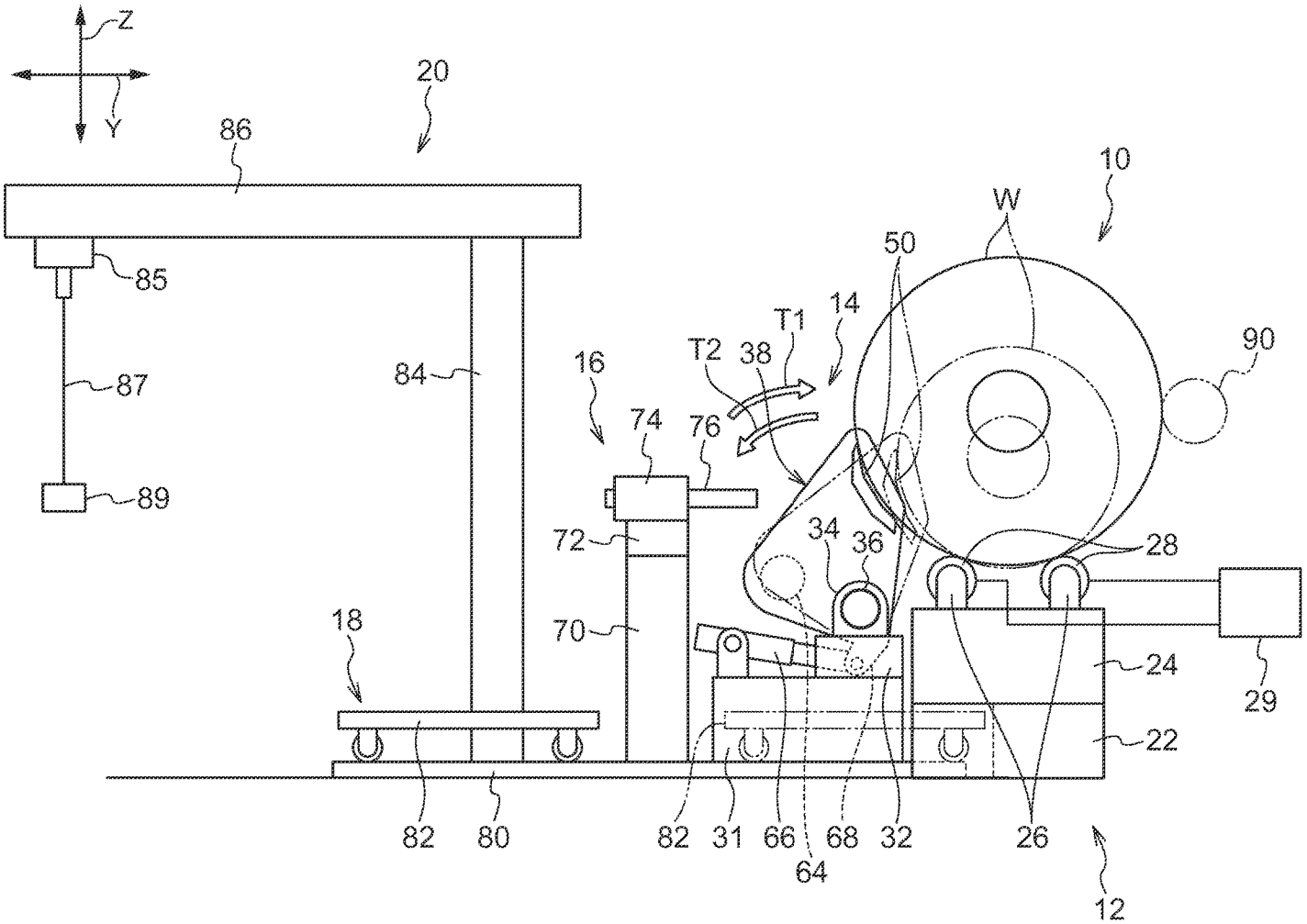
FIG. 2 is a side view illustrating a schematic configuration of a coil sample collection device in which the opening method according to an exemplary embodiment of the present invention is applied.
Figure 3:
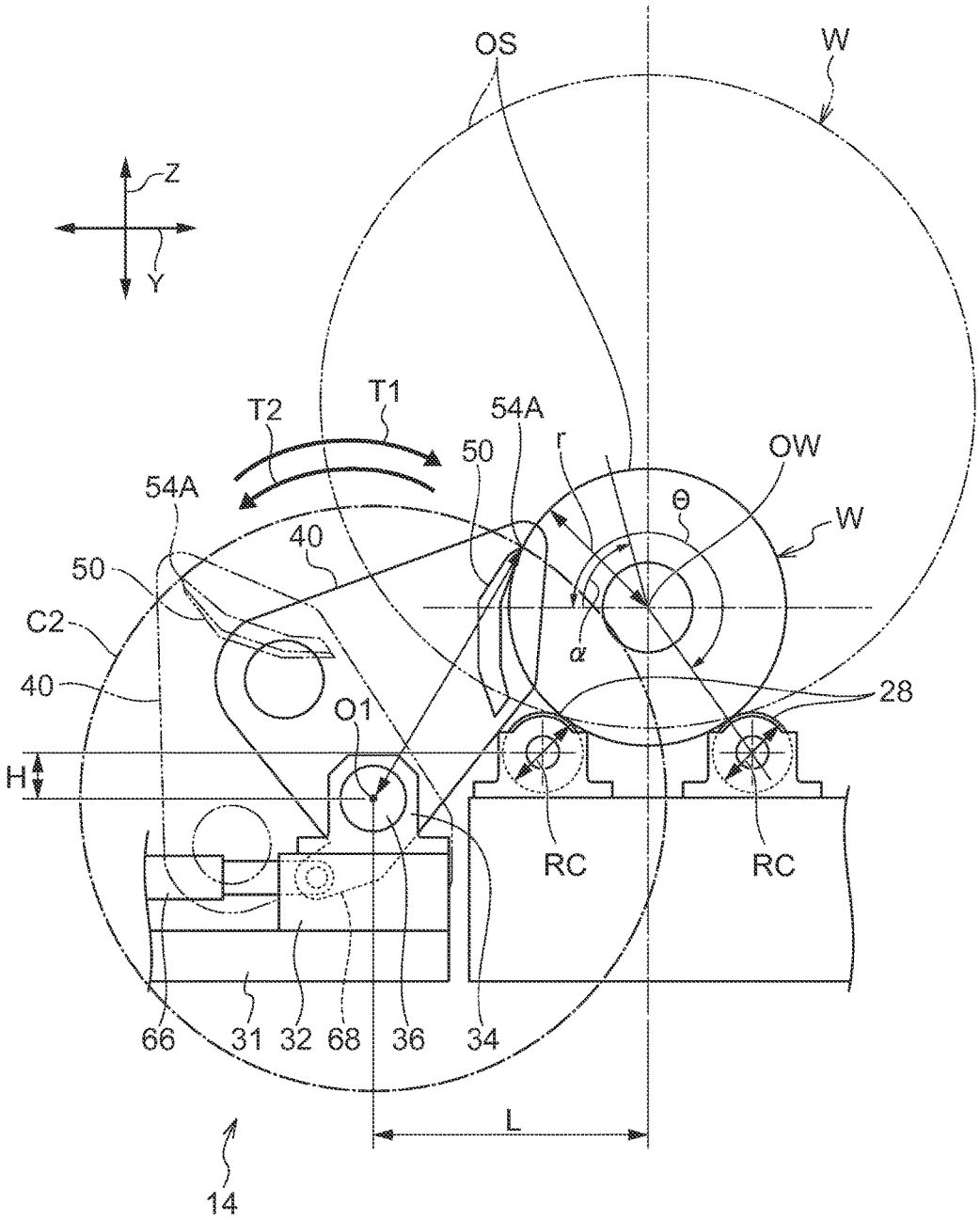
FIG. 3 is an explanatory diagram of details of an opening mechanism according to an exemplary embodiment of the present invention.

FIG. 1 and FIG. 2 are a perspective view and a side view respectively illustrating a schematic configuration of the coil sample collection device 10 according to an exemplary embodiment. FIG. 3 is a detailed diagram illustrating of the opening mechanism 14.

As illustrated in FIG. 1 and FIG. 2, the coil sample collection device 10 includes, for example, a cradle mechanism 12, an opening mechanism 14, a gas cutter mechanism 16, a take-out mechanism 18, and a jib crane 20.

In the present exemplary embodiment, the metal coil W is, for example, wound from a steel sheet MS of from 1.2 mm to 25.4 mm thickness, and has an outer diameter D of from about 1000 mm to 2600 mm. In particular, the coil sample collection device 10 is suitably applied to a metal coil W wound from steel sheet MS of thickness 4.5 mm or above.

As illustrated in FIG. 1 and FIG. 2, the cradle mechanism 12 includes a base 22, a support table 24 mounted to a top portion of the base 22, two pairs of pillow blocks 26 placed on the support table 24 a specific distance apart from each other in the Y direction, and a pair of cradle rolls 28 rotatably supported between the respective two pairs of pillow blocks 26.

A rail housing section 30 is formed below the support table 24 by hollowing out a portion of the base 22. Rails 80, described below, are provided extending as far as the rail housing section 30, enabling a take-out trolley 82 that runs on the rails 80 to move to a position (see the double-dashed intermittent lines in FIG. 2) to receive steel sheet MS (test sample S) cut from the metal coil W.

The pair of cradle rolls 28 are respectively supported at both end portions by respective pairs of pillow blocks 26 so as to be capable of rotating, and are rotationally driven by a drive section 29 (see FIG. 2). This thereby enables the metal coil W to be rotated on the pair of cradle rolls 28.

As illustrated in FIG. 1 and FIG. 2, the opening mechanism 14 includes a pair of opening mechanism support bases 31 disposed on either side of the rails 80, described below. A pillow block 34 supported by a respective support block 32 is provided on the top face of each of the pair of opening mechanism support bases 31. Rotation shafts 36 are respectively provided in the pair of pillow blocks 34 so as to be rotatable. An opening blade body support mechanism 38 is rotatably supported by the pair of rotation shafts 36.

Figure 5A:
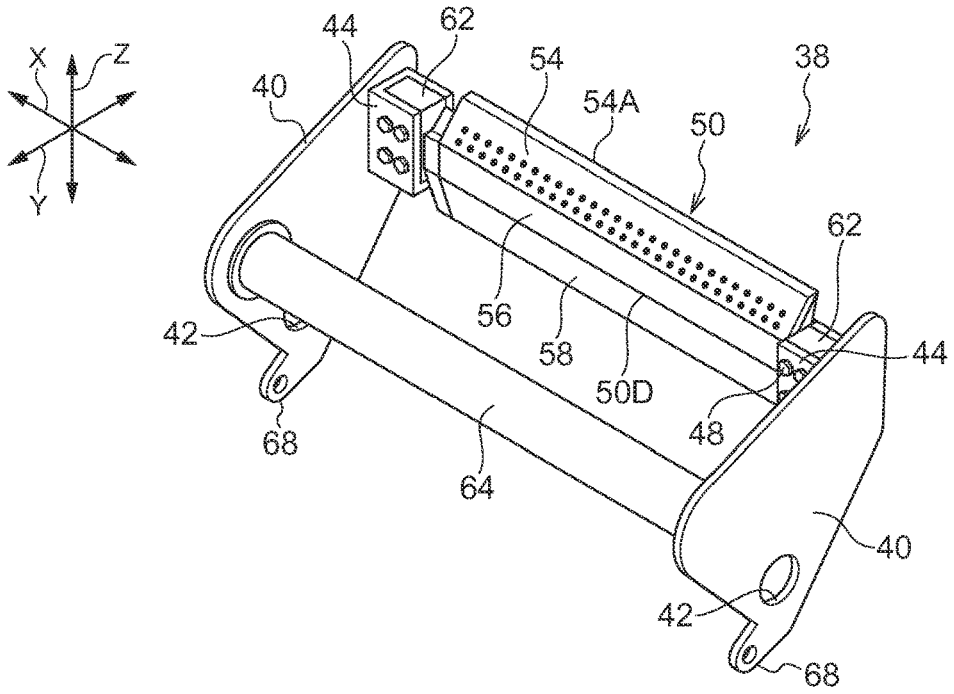
FIG. 5A is a perspective view illustrating an opening blade body support mechanism according to an exemplary embodiment of the present invention.
Figure 5B:
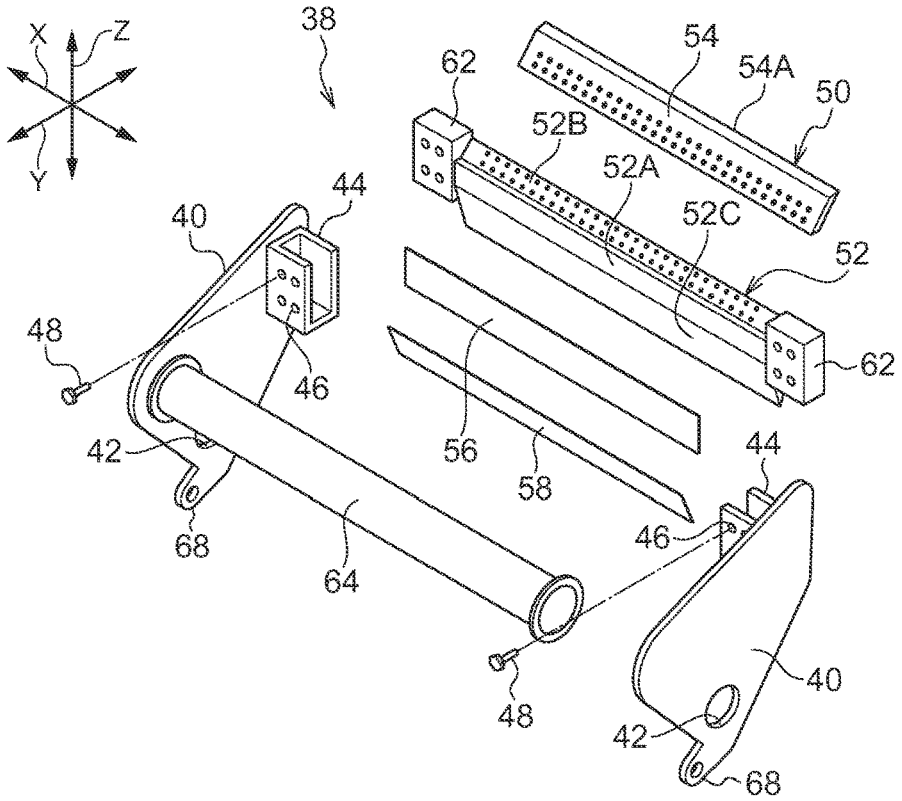
FIG. 5B is an exploded perspective view illustrating an opening blade body support mechanism according to an exemplary embodiment of the present invention.

As illustrated in FIG. 5A and FIG. 5B, the opening blade body support mechanism 38 includes quadrangular shaped opening blade support members 40. The opening blade support members 40 are rotatably supported on the rotation shafts 36 by the rotation shafts 36 being inserted and fixed into holes 42 formed in the vicinity of a lower end of the opening blade support member 40.

As illustrated in FIG. 5A and FIG. 5B, box bodies 44 with openings facing upward and toward the inside are provided at opposing side surfaces of the opening blade support member 40. Engaging sections 62 of an opening blade body 50, described below, are housed in the box bodies 44 by being fitted into the box bodies 44 from above, and the opening blade body 50 is fixed to the opening blade support member 40 by screwing bolts 48 into threaded holes 46 formed in the box bodies 44.

Figure 4:
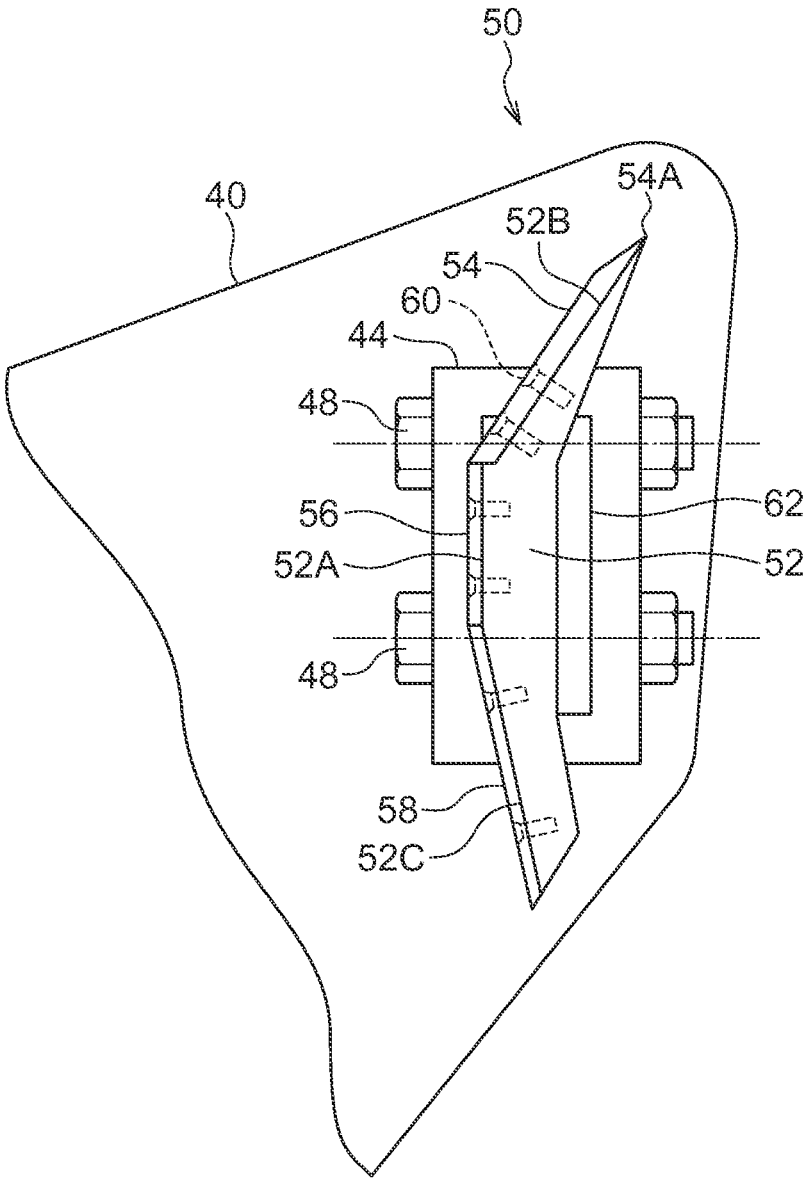
FIG. 4 is a partial cross-section side view illustrating details of an opening blade body according to an exemplary embodiment of the present invention.

As illustrated in FIG. 4, FIG. 5A, and FIG. 5B, the opening blade body 50 includes a blade body attachment member 52, an opening blade main body 54, and protectors 56 and 58 made from heat-resisting steel plate.

As illustrated in FIG. 5B, the blade body attachment member 52 is formed in a substantially C shape in side view (see FIG. 4) and includes a reference face 52A on the opposite side to the metal coil W, a topside inclined face 52B formed to a top portion of the reference face 52A, and a bottom side inclined face 52C formed to a bottom portion of the reference face 52A.

The opening blade main body 54 is attached to the topside inclined face 52B by screws 60 (see FIG. 4). The opening blade main body 54 is formed with a blade tip 54A for opening the leading end of the metal coil W. The blade tip 54A projects upward further than the topside inclined face 52B of the blade body attachment member 52. Namely, the opening blade body 50 is configured such that the blade tip 54A makes contact with an outer peripheral surface OS of the metal coil W when the opening blade body 50 has approached the metal coil W.

Similarly, the protectors 56, 58 are attached to the reference face 52A and the bottom side inclined face 52C by screws 60. The blade body attachment member 52 is thereby protected by the protectors 56, 58 from the flame during gas-cutting of the test sample S from the metal coil W.

At both width direction ends of the blade body attachment member 52, the pair of engaging sections 62 are formed in rectangular box shapes so as to be capable of being inserted into the box bodies 44. The blade body attachment member 52 is accordingly attachable to the opening blade support member 40 by inserting the engaging sections 62 into the box bodies 44 and fixing with bolts 48 or the like.

Moreover, a reinforcement member 64 is attached between the pair of opening blade support members 40 so as to maintain a fixed separation between the opening blade support members 40.

As illustrated in FIG. 1 and FIG. 2, hydraulic cylinders 66 are respectively provided on the top faces of the pair of opening mechanism support bases 31, and leading ends of rods of the hydraulic cylinders 66 are rotatable coupled to respective levers 68 of the opening blade support members 40 (see the broken lines in FIG. 2 and FIG. 3). The opening blade support members 40 are consequently configured so as to swing in the arrow T1 and the arrow T2 directions about the axial center O1 of the rotation shafts 36, as illustrated in FIG. 3, by extension and contraction of the rods of the hydraulic cylinders 66.

The opening mechanism 14 is, as illustrated in FIG. 3, offset in the vertical (Z) direction by dimension H from the pair of cradle rolls 28, and offset in the horizontal (Y) direction by a dimension L from the center of the pair of cradle rolls 28 (the axial center OW of the metal coil W). Preferably configuration is made such that respective tangents at the intersection points between the outer peripheral surface OS of the metal coil W mounted on the cradle rolls 28 and a circular arc path C2 when the blade tip 54A of the opening blade body 50 swings are always orthogonal to each other.

The metal coil W mounted on the pair of cradle rolls 28 forms a curved beam WB (see FIG. 6B) originating from the right side cradle roll 28 and curving around anticlockwise. The symbol Θ in FIG. 3 indicates the angle about the axial center OW of the metal coil W from the cradle roll 28 at the origin of the curved beam WB to the load action point P where the curved beam WB is supported by the opening blade body 50.

The gas cutter mechanism 16 includes a slider base 72 that extends in the X direction so as to straddle between gas-cutting mechanism bases 70 provided at the outside of the rails 80. A slider body 74 that slides on the slider base 72 in the X access is provided to the slider base 72. The slider body 74 includes a gas torch 76 capable of directing a flame onto the metal coil W. The gas torch 76 cuts the steel sheet MS by moving from the right edge of the slider base 72 toward the center, and then from the left edge toward the center, so as to finish at the width direction central of the steel sheet MS.

The take-out mechanism 18 is employed to take out the test sample S cut from the leading end portion of the steel sheet MS configuring the metal coil W by the gas cutter mechanism 16. The take-out mechanism 18 includes the rails 80 installed on the floor, and the take-out trolley 82 moveably mounted on the rails 80. As illustrated in FIG. 1 and FIG. 2, the rails 80 extend in the Y direction from the rail housing section 30 to the jib crane 20. The leading edge of the take-out trolley 82 enters the rail housing section 30, enabling the take-out trolley 82 to be stopped at the drop position of the steel sheet MS (the test sample S) cut by the gas cutter mechanism 16.

The jib crane 20 includes a crane arm 86 that is supported on a column 84 provided upright in the floor so as to be capable of swinging in a horizontal direction. A take-up device 85 is provided in the crane arm 86, and the test sample S is picked up by an electromagnet 89 provided at the leading end a wire 87, and conveyed to a test sample bucket 88.

Figure 6A:
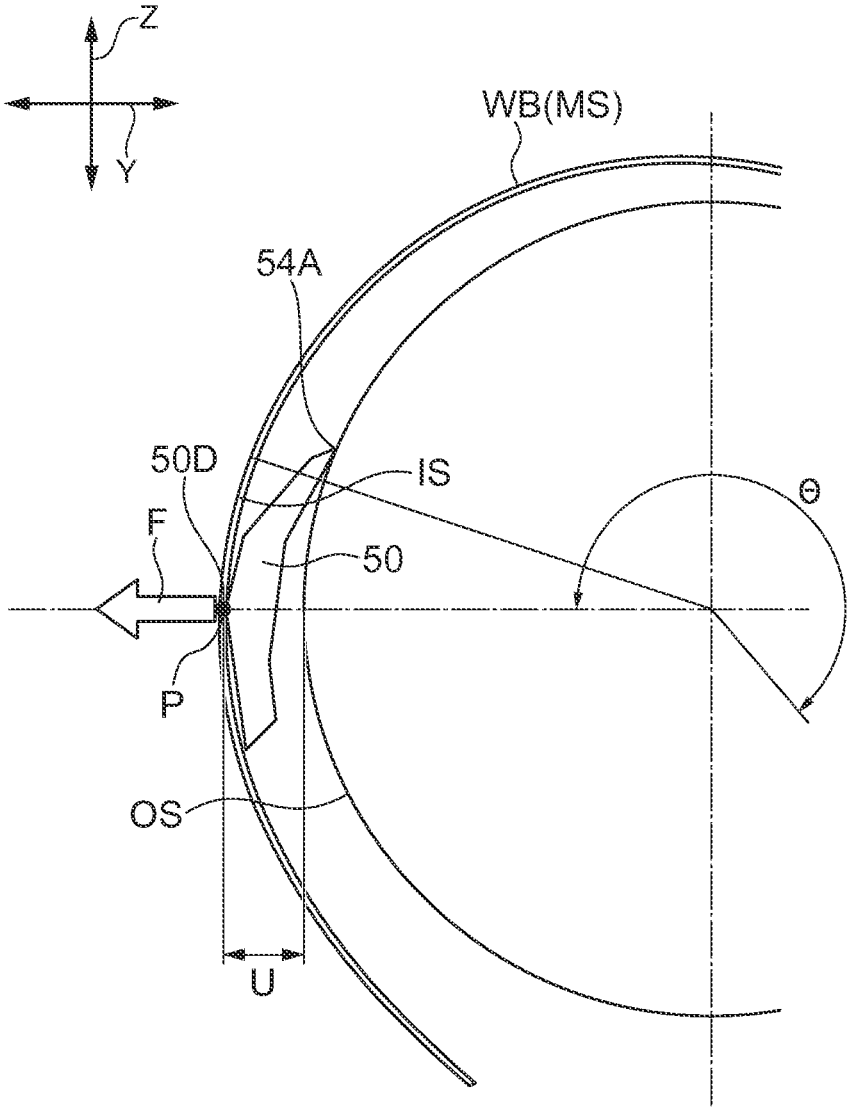
FIG. 6A is diagram schematically illustrating a relationship between an opening blade body and a metal coil at opening in a coil sample collection device according to an exemplary embodiment of the present invention.
Figure 6B:
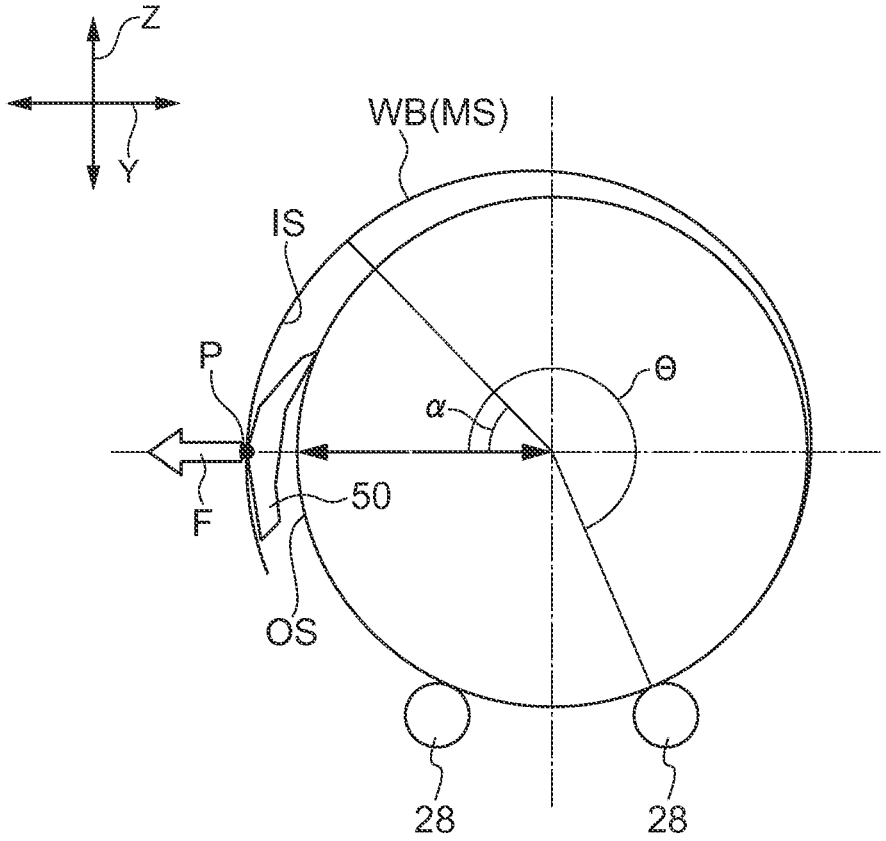
FIG. 6B is overview schematically illustrating a relationship between an opening blade body and a metal coil at opening in a coil sample collection device according to an exemplary embodiment of the present invention.
Figure 6C:
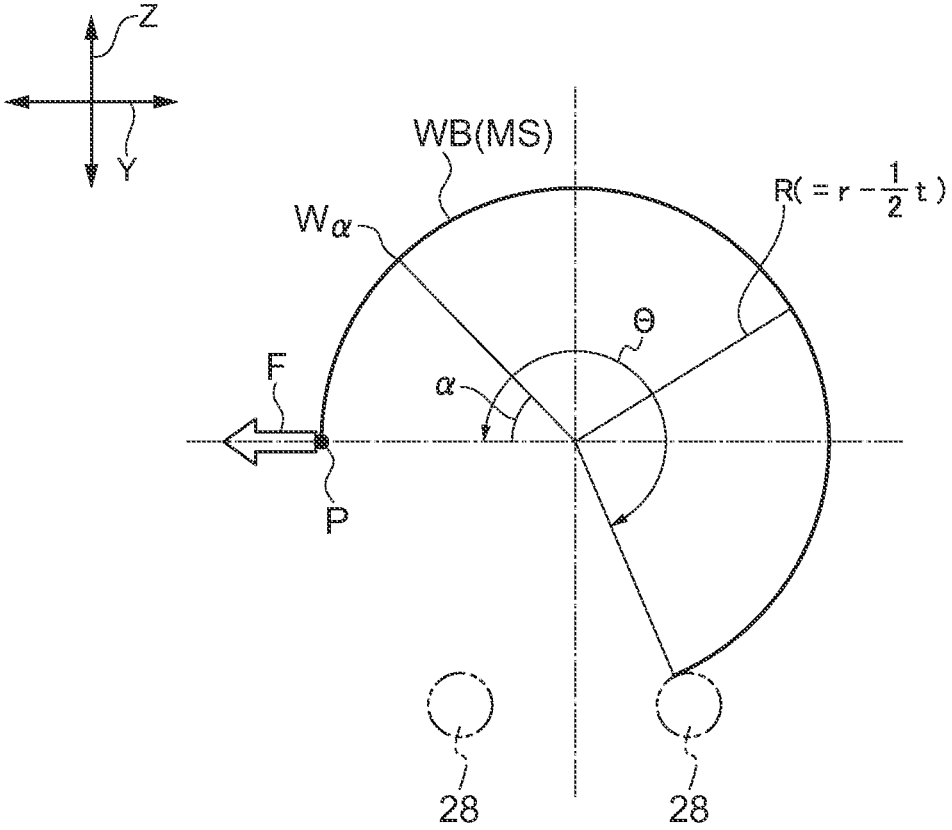
FIG. 6C is a diagram illustrating a computation model of an exemplary embodiment of the present invention.

Explanation next follows regarding dimensional settings of the opening blade body 50 according to an exemplary embodiment of the present invention, with reference to FIG. 6A to FIG. 6C.

FIG. 6A is a side view illustrating positional relationships between the opening blade body and the metal coil during opening, and FIG. 6B is a side view illustrating overall positional relationships between the opening blade body and the metal coil during opening. FIG. 6C is a schematic explanatory diagram of a computation model.

Figure 7A:
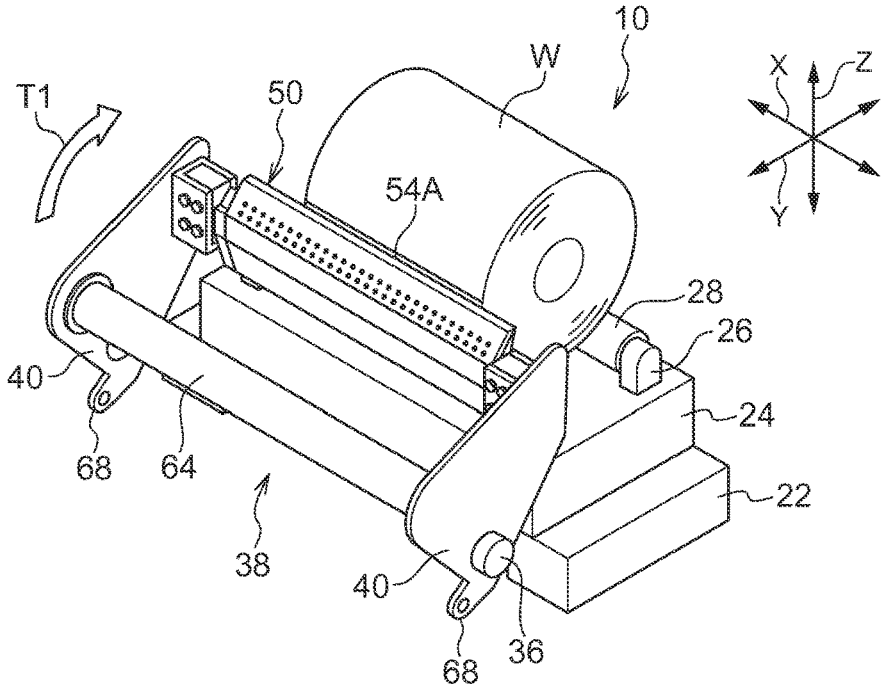
FIG. 7A an explanatory diagram of the operation of a coil sample collection device according to an exemplary embodiment of the present invention, and illustrates a contacted state of an opening blade body against the outer peripheral surface of a metal coil.

As illustrated in FIG. 7A, when the blade tip 54A of the opening blade body 50 contacts the outer peripheral surface OS of the metal coil W and the metal coil W is rotated, the blade tip 54A is inserted inside the steel sheet MS from a leading end portion of the metal coil W. As illustrated in FIG. 6A and FIG. 6B, when the metal coil W is opened by the opening blade body 50, the inner peripheral surface IS of the steel sheet MS configuring the metal coil W is supported by a ridge line 50D, described below, of the opening blade body 50, and the curved beam WB from the cradle roll 28 at the right side in FIG. 6B to the opening blade body 50 is formed by the steel sheet MS. In such a situation, a radial direction load F acts from the opening blade body 50 in a direction toward the radial direction outside of the metal coil W (as illustrated in FIG. 6A, and FIG. 6B) on the portion (referred to below as the load action point) P where the inner peripheral surface IS of the steel sheet MS is supported by the opening blade body 50, as a reaction force to the recovery force (resilience) of the metal coil W. A radial direction permissible dimension K is derived such that plastic deformation does not occur in the curved beam WB due to the radial direction load F, and an opening radial direction dimension U of the opening blade body 50, described below, is set to be smaller than the radial direction permissible dimension K.

Detailed explanation follows.

Explanation first follows regarding a computation model to derive the radial direction permissible dimension K, with reference to FIG. 6C. As illustrated in FIG. 6C, consider a curved beam WB of radius (r−t/2) having one end fixed and the other end free, wherein r is the radius of the metal coil W, and t is the plate thickness of the steel sheet MS forming the metal coil W. Namely, the curved beam WB is modeled as the neutral plane of the steel sheet MS forming the outer peripheral surface OS (outermost layer) of the metal coil W. The fixed end is the position of the right side cradle roll 28 nearest to the load action point P along the rewind direction (clockwise in FIG. 6C).

The computation model is employed to compute the radial direction load F acting toward the radial direction outside of the curved beam WB at the free end of the curved beam WB (the left end in FIG. 6).

The deflection (radial direction displacement) u at the free end of the curved beam WB is derived in the computation model. Castigliano's theorem is employed in the computation. Computation is made using (r−t/2)=R.

First, with the center of the curved beam WB as the origin, the bending moment M acting on the curved beam WB at point Wα of angle α from the free end to the fixed end side is derived.

The bending moment M acting at Wα is expressed by:

$$M=F\times R\times\sin\alpha \qquad \text{Equation (1)}$$

Then the strain energy V acting on the curved beam WB (from the free end (s=0) to the fixed end (s=RΘ)) is derived.

$$V=\int_0^{R\Theta}\frac{M^2}{2EI}ds=\int_0^{\Theta}\frac{M^2}{2EI}Rd\alpha \qquad \text{Equation (2)}$$

Wherein:

R is the radius r of the metal coil W from which ½ the plate thickness t of the steel sheet MS has been subtracted (r−(½)t) (mm)

E is the Young's modulus of the steel sheet MS (kgf/mm$^2$)

I is the second moment of area of the steel sheet MS (mm$^4$)

Θ is the angle (rad) about the axis of the metal coil W from the load action point P formed by insertion of the opening blade body 50 to the cradle roll 28 nearest to the load action point P along the metal coil rewind direction.

The radial direction displacement u (mm) at the free end is derived by partial differentiation of the strain energy V with respect to the radial direction load F acting at the free end of the curved beam WB (the load action point P).

$$\begin{aligned}u&=\frac{\partial V}{\partial F}\\&=\frac{\partial}{\partial F}\int_0^{\Theta}\frac{M^2}{2EI}Rd\alpha\\&=\frac{\partial}{\partial F}\left[\frac{R}{2EI}\left[\int_0^{\Theta}(FR\sin\alpha)^2d\alpha\right]\right]\\&=\frac{\partial}{\partial F}\left[\frac{F^2}{2EI}R^3\int_0^{\Theta}(\sin\alpha)^2d\alpha\right]\\&=\frac{F}{EI}R^3\times\frac{1}{2}\int_0^{\Theta}(1-\cos2\alpha)d\alpha\\&=\frac{F}{2EI}R^3\left[\alpha-\frac{1}{2}\sin2\alpha\right]_0^{\Theta}\\&=\frac{F}{2EI}R^3(\Theta-\sin\Theta\cos\Theta)\end{aligned} \qquad \text{Equation (3)}$$

The maximum bending moment to apply to the curved beam WB is then derived as the radial direction load F at the start of yield (elastic limit) of the curved beam WB. Namely, the bending moment M is calculated at the limit when plastic deformation starts to occur in the steel sheet MS forming the metal coil W.

The elastic limit bending moment M is expressed using the yield stress Yp and the section modulus of the steel sheet MS as:

$$M=Yp\times Z \qquad \text{Equation (4)}$$

Wherein:

Yp is the yield stress of the steel sheet MS (kgf/mm$^2$); and

Z is the section modulus of the steel sheet MS(=(⅙)bt$^2$) (mm$^3$), wherein b is the width of the steel sheet MS (mm), and t is the plate thickness of the steel sheet MS (mm).

From Equation (1), the bending moment is at a maximum in the curved beam WB (0<Θ<2π) at the positions α=(π/2), (3π/2). However, the sign for the radial direction load F is minus at the position (3π/2), meaning the bending moment occurs in the reverse direction, and so plastic deformation is not expected. Hence the position of the bending moment maximum is at α=(π/2).

Therefore, the elastic limit bending moment M is $$M=Yp\times Z=F\times R\times\sin(\pi/2) \qquad \text{Equation (5)}$$

Wherein Yp, Z, and R are constants.

Rearranging Equation (5) for F shows that the radial direction load F when the elastic limit bending moment M is acting is:

$$\begin{aligned}F&=(Yp\times Z)/(R\times\sin(\pi/2))\\&=(Yp\times Z)/R\end{aligned} \qquad \text{Equation (6)}$$

Substituting F of Equation (3) into Equation (6) gives the radial direction maximum displacement amount of the free end such that plastic deformation does not occur in the curved beam WB. This is the radial direction permissible dimension K. Namely:

$$K=\frac{Yp\times Z}{2EI}R^2(\Theta-\sin\Theta\cos\Theta) \qquad \text{Equation (7)}$$

During opening, taking the opening radial direction dimension U of the steel sheet MS due to the opening blade body 50 as the radial direction distance (mm) from the load action point P where the opening blade body 50 supports the inner peripheral surface IS of the steel sheet MS (for example, the ridge line 50D formed on the opening blade body 50 by the protectors 56, 58) to the outer peripheral surface OS of the metal coil W (mm), then as long as $$U\leq K \qquad \text{Equation (8)}$$

is satisfied, the curved beam WB of the steel sheet MS formed at the leading end of the metal coil W by the opening blade body 50 falls within the scope of elastic deformation, and plastic deformation does not occur.

Thus in the coil sample collection device 10, the shape of the opening blade body 50 and the orientation (contact angle and the like) with respect to the outer peripheral surface OS of the metal coil W is accordingly determined such that the position of the load action point P is within the radial direction permissible dimension K.

The opening blade body 50 should follow the beam shape of the curved beam WB, and so the shape of the opening blade body 50 is preferably set such that the leading end side of the opening blade body 50 gradually displaces toward the radial direction inner side in the rewind direction of the coil.

The metal coil W has, for example:

An outer diameter D of the metal coil W (=2×the radius r of the metal coil W) of from 1000 mm to 2600 mm.

A plate thickness t of from 1.2 mm to 25.4 mm.

A plate width b of from 600 mm to 2180 mm.

A yield stress Yp of 24.0 $kgf/mm^2$.

A Young's modulus E of 21000 $kgf/mm^2$.

A second moment of area I of $(bt^3/12)$ $mm^4$.

A section modulus Z of $(bt^2/6)$ $mm^3$.

The metal coil W has a radial direction permissible dimension K of 289.7 mm for a coil radius r of 1200 mm, a plate thickness t of 25.4 mm, and a plate width b of 2180 mm.

Thus when, for example, the metal coil W has a coil radius r=1200 mm, a plate thickness t=25.4 mm, and a plate width b=2180 mm, the opening radial direction dimension U of the opening blade body 50 is appropriately set at the radial direction permissible dimension K (=289.7 mm) or lower. Moreover, if the opening radial direction dimension U of the opening blade body 50 is set at 289.7 mm, then application can be made to metal coils W with a coil radius r of larger than 1200 mm.

Explanation next follows regarding operation of the coil sample collection device 10, with reference to FIG. 7A to FIG. 7E. Explanation first follows regarding operation of coil sample collection in the coil sample collection device 10.

(1) First, as illustrated in FIG. 7A, the metal coil W is mounted onto the cradle rolls 28 of the cradle mechanism 12.

Then, as illustrated in FIG. 1 and FIG. 2, the opening mechanism 14 is swung in the arrow T1 direction about the rotation shafts 36 by driving the hydraulic cylinders 66, moving the opening blade body 50 toward the metal coil W side (see FIG. 2 and FIG. 3), and contacting the blade tip 54A of the opening blade body 50 against the outer peripheral surface OS of the metal coil W.

Figure 7B:
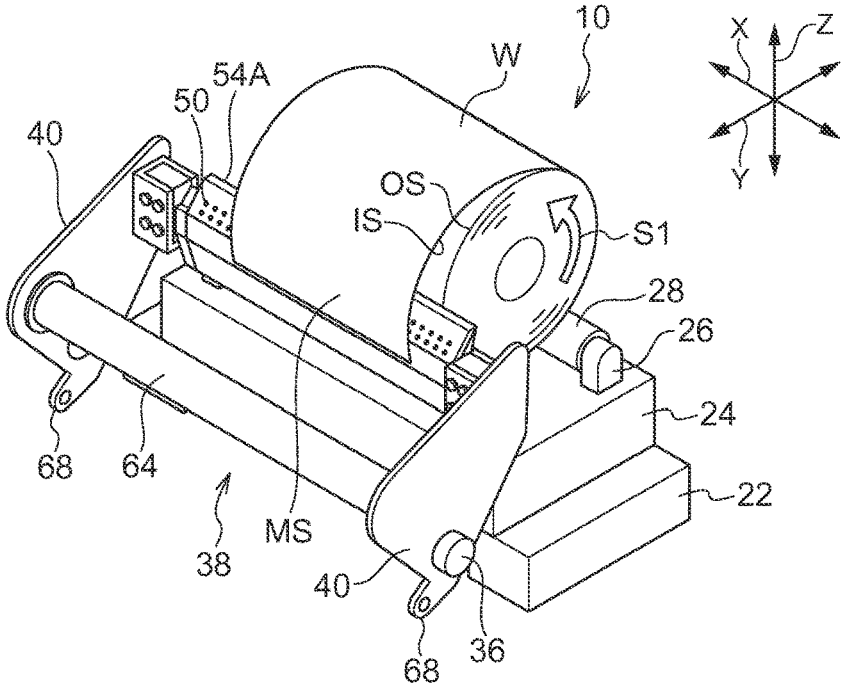
FIG. 7B an explanatory diagram of the operation of a coil sample collection device according to an exemplary embodiment of the present invention, and illustrates a metal coil in a state opened by an opening mechanism.

(2) Then, as illustrated in FIG. 7B, the metal coil W is rotated in the arrow S1 direction by the drive section 29 (see FIG. 2) driving the cradle rolls 28. The leading end portion of the steel sheet MS configuring the metal coil W is thereby guided over the opening blade body 50 by the blade tip 54A of the opening blade body 50, and separated from the outer peripheral surface OS of the metal coil W. Namely, the opening of the metal coil W is opened.

Figure 7C:
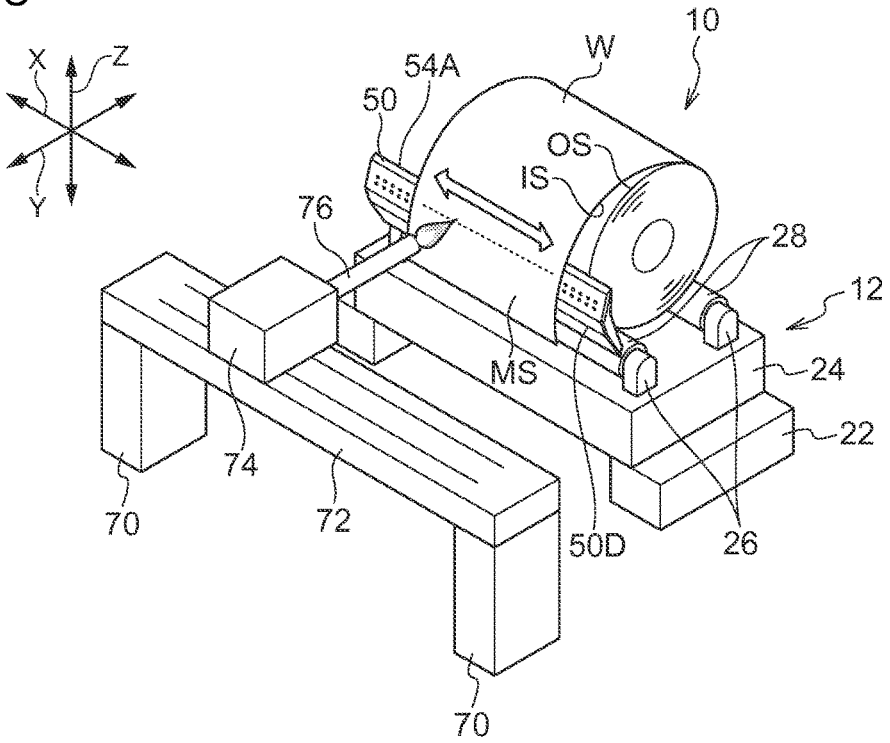
FIG. 7C an explanatory diagram of the operation of a coil sample collection device according to an exemplary embodiment of the present invention, and illustrates a state in which the opened steel sheet is being cut.

(3) Moreover, by continuing rotation of the metal coil W, as illustrated in FIG. 7C, the inner peripheral surface IS of the steel sheet MS lifted up over the opening blade body 50 becomes supported at the load action point P (for example the ridge line 50D). Driving of the cradle rolls 28 is then stopped when a specific length of the steel sheet MS has been drawn out. The leading end of the steel sheet MS (further to leading end side than the load action point P) is accordingly in a free state. The gas torch 76 is then driven while moving the slider body 74 on the slider base 72 of the gas cutter mechanism 16 in the X direction. As a result, the steel sheet MS of the metal coil W supported by the opening blade body 50 is cut at a specific position.

Figure 7D:
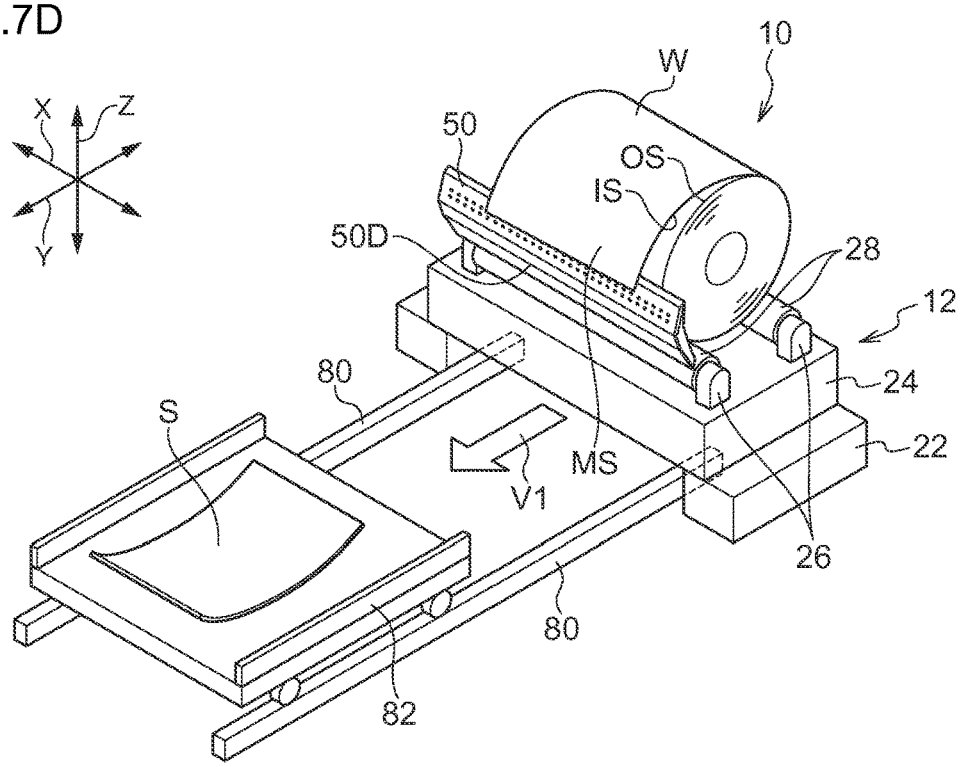
FIG. 7D an explanatory diagram of the operation of a coil sample collection device according to an exemplary embodiment of the present invention, and illustrates a state in which a cut test sample is being transported on a trolley.

(4) Then, as illustrated in FIG. 7D, the test sample S cut by the gas cutter mechanism 16 is dropped onto the take-out trolley 82 (see the take-out trolley 82 depicted by double dot intermittent lines in FIG. 2) positioned at an X direction end section of the rails 80 (a state in which the leading end of the take-out trolley 82 enters into the rail housing section 30). The take-out trolley 82 on which the test sample S is mounted then moves in the arrow V1 direction.

Figure 7E:
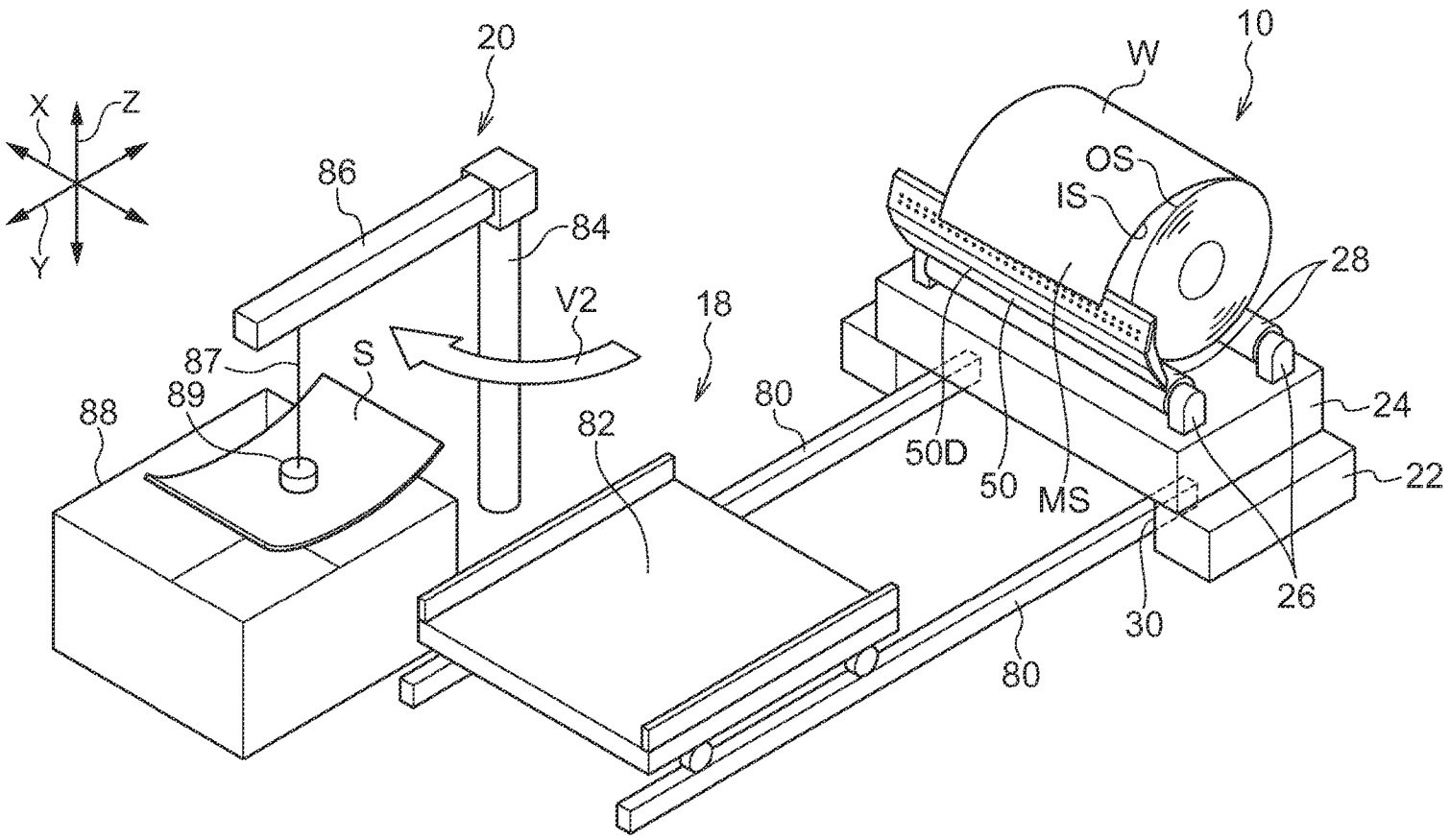
FIG. 7E an explanatory diagram of the operation of a coil sample collection device according to an exemplary embodiment of the present invention, and illustrates a state in which a test sample transported by a trolley is being removed by a jib crane.

(5) Then, as illustrated in FIG. 7E, the test sample S taken out by the take-out trolley 82 is moved upward from the take-out trolley 82 and in the arrow V2 direction using the jib crane 20, and conveyed to the test sample bucket 88.

When opening the metal coil W, the coil sample collection device 10 according to the present exemplary embodiment enables opening of the steel sheet MS positioned at the outer peripheral side of the opening blade body 50 while still curved in an curved beam WB state. Accordingly, displacement toward the radial direction outer side of the metal coil W can be suppressed from occurring in the steel sheet MS.

In such situations, the opening blade body 50 is disposed such that the opening radial direction dimension U of the opening blade body 50 is the radial direction permissible dimension K for the curved beam WB elastic limit or lower, suppressing plastic deformation from occurring in the opened steel sheet MS of the metal coil W.

As a result, plastic deformation that is damaging to the rewound metal coil W can be suppressed from occurring.

In particular, when the plate thickness of the steel sheet MS configuring the metal coil W is, for example, 4.5 mm or thicker, there is a high possibility of the leading end of the steel sheet MS of the metal coil W being straightened out in a straight line shape over the opener board and plastic deformation occurring in the curved beam WB in cases in which the rectangular opener board described in the background technology is employed. In contrast thereto, with the coil sample collection device 10 of the present exemplary embodiment, the steel sheet MS configuring the curved beam WB is only supported at the load action point P, and the leading end side from this point onwards is in a free state maintaining a curved state. Consequently, straightening out over the opening blade body 50 and plastic deformation can be suppressed from occurring even in cases in which the plate thickness t of the steel sheet MS is large.

This enables collection of the test sample S while the metal coil W remains curved, suppressing the portion to be cut from being straightened out in the vertical direction, and enabling the test sample S cut from the metal coil W to be dropped onto the take-out trolley 82 disposed on the floor.

As a result, there is no need to form a channel of the like in the floor for the take-out trolley 82 when installing the coil sample collection device 10, enabling the facility investment cost to be suppressed. Easy and efficient collection of the test sample S is enabled, enabling the running costs for handling to be reduced.

The coil sample collection device 10 also enables the opening blade body 50 to be moved while maintaining an angle in a specific range with respect to the outer peripheral surface OS of the metal coil W, irrespective of the diameter of the metal coil W, using the swing mechanism that is capable of swinging about an axis parallel to the cradle rolls 28. This thereby enables contact of the opening blade body 50 with the outer peripheral surface OS of the metal coil W at a specific angle, and enables the influence from the shape of the curved beam WB due to the outer diameter of the metal coil W to be suppressed.

In particular, configuring such that a path C2 of the blade tip 54A of the opening blade body 50 is always orthogonal to the tangent at the intersection point with the outer peripheral surface OS of the metal coil W, means that it is possible for the opening blade body 50 to contact the outer peripheral surface OS of the metal coil W at a constant angle irrespective of the diameter of the metal coil W.

The coil sample collection device 10 cuts the steel sheet MS with its inner peripheral surface IS supported on the opening blade body 50, enabling the steel sheet MS to be cut while stably supported.

Moreover, in the coil sample collection device 10, the opening blade body 50 is covered by the protectors 56, 58, and so damage to the blade body attachment member 52 of the opening blade body 50 by the flame of the gas torch 76 is suppressed when samples are collected from the metal coil W by gas-cutting or the like.

Moreover, the location of the steel sheet MS where the inner peripheral surface IS is supported by the opening blade body 50 is cut, thereby enabling sputter, slag, and the like when gas-cutting to be suppressed from adhering to the outer peripheral surface of the metal coil W.

The coil sample collection device is not limited to the technology disclosed herein, and various modifications are possible.

For example, explanation has been given in the above exemplary embodiment of a case in which the coil sample collection device 10 includes the opening mechanism 14 with the blade body attachment member 52, the opening blade main body 54, the protector 56, and the protector 58. However, the material, shape, position, placement and the like of the opening blade body 50 in the opening mechanism 14 is not limited to the technology disclosed herein, and may be set.

Moreover, explanation has been given in the above exemplary embodiment of a case in which the opening mechanism 14 configuring the coil sample collection device 10 has a swing mechanism; however, in place of the swing mechanism, for example, configuration may be made such that the opening blade body 50 moves in a straight line.

Moreover, although explanation has been given in the above exemplary embodiment of a case in which the coil sample collection device 10 includes the gas cutter mechanism 16 for cutting the test sample S from the metal coil W, configuration may be made with a plasma cutter, a laser cutter, or the like, in place of the gas cutter mechanism 16.

Using a gas, plasma, and laser in this manner enables reliable cutting even if the steel sheet MS is 4.5 mm or thicker. In contrast thereto, it is difficult to cut a steel sheet MS of 4.5 mm or thicker with a blade.

In the exemplary embodiment described above, explanation has been given of a case in which the opening blade body 50 includes the protectors 56, 58 that cover the blade body attachment member 52 and the opening blade main body 54 when the gas cutter mechanism 16 is cutting and protect them from the flame of the gas torch 76; however, the protectors 56, 58 of the gas torch 76 may be omitted. Moreover, for example, a spray covering film or the like may be provided to the blade body attachment member 52 in place of the protectors 56, 58.

Moreover, in the exemplary embodiment described above, explanation has been given of a case in which the coil sample collection device 10 includes the gas cutter mechanism 16, the take-out mechanism 18, and the jib crane 20; however, configuration may be made without the gas cutter mechanism 16, the take-out mechanism 18, or the jib crane 20. The configurations of the gas cutter mechanism 16, the take-out mechanism 18, and the jib crane 20 are also not limited to the technology disclosed herein.

In the present exemplary embodiment, configuration is made with the metal coil W restrained from the outer peripheral surface OS of the metal coil W by the pair of cradle rolls 28 alone; however a separate coil restraining roll 90 (see the double dash intermittent lines in FIG. 2) may be provided between the cradle rolls 28 and the opening blade body 50 (at the right side of FIG. 6B). In such cases, for example, positioning is preferably at the 3 O'clock position in FIG. 2.

In cases in which the coil restraining roll 90 is disposed between the cradle roll 28 and the opening blade body 50, the angle Θ is the angle from the load action point P to the portion restrained by the coil restraining roll 90. This is because the curved beam WB is formed between the load action point P and the coil restraining roll 90, and is in order to correctly derive the radial direction permissible dimension K.

Explanation has been given in the exemplary embodiment described above of a case in which the metal coil W is steel sheet of from 1.2 mm to 25.4 mm wound to a coil outer diameter of from 1000 mm to 2600 mm, however, metal coils with dimensions outside of these ranges are not excluded. Moreover, in place of the steel sheet, various metal sheets each having an elastic deformation range and a plastic deformation range, such as, for example, copper, aluminum, or the like may applied to the metal coil. There is also no particular limitation to the width, thickness, and coil diameters of the metal sheets in such cases either.

What is claimed is:

1. An opening method, comprising:

restraining an outer peripheral surface of a metal coil of a wound metal sheet with a plurality of restraining rolls;

disposing an opening blade body and contacting a blade tip of the opening blade body onto the outer peripheral surface of the metal coil;

rotating the metal coil in an opposite direction to a take-up direction of the metal coil to insert the blade tip inside the metal sheet from a leading end portion of the metal sheet to separate the leading end portion of the metal sheet from the metal coil using the opening blade body; and continuing rotation of the metal coil in the opposite direction to support an inner peripheral surface of the metal sheet at a load action point of the metal sheet at which the inner peripheral surface of the metal sheet is supported by a supporting portion of the opening blade body using the opening blade body with the leading end portion of the metal sheet in a free state so as to satisfy the following Equation (1) and Equation (2):

$$K = \frac{Yp \times Z}{2EI} R^2(\Theta - \sin\Theta\cos\Theta) \quad \text{[Equation (1)]}$$

$$U \leq K \quad \text{[Equation (2)]}$$

wherein:

U is an opening radial direction dimension, from the load action point of the metal sheet to the outer peripheral surface of the metal coil, in mm;

K is a radial direction permissible dimension at the load action point position, from the inner peripheral surface of the metal sheet to the outer peripheral surface of the metal coil, in mm;

Yp is a yield stress of the metal sheet, in kgf/mm$^2$;

Z is a section modulus of the metal sheet (=(1/6) bt$^2$), in mm$^3$, wherein b is a width of the metal sheet, in mm, and t is a plate thickness of the metal sheet, in mm;

R is a metal coil radius r from which one-half of the plate thickness t of the metal sheet has been subtracted (r −(½) t), in mm;

E is a Young's modulus of the metal sheet, in kgf/mm$^2$;

I is a second moment of area of the metal sheet, in mm$^4$; and

Θ is an angle in radians about an axis of the metal coil from the load action point to a portion restrained by a nearest restraining roll of the restraining rolls that is nearest to the load action point along a rewind direction of the metal coil.

2. The opening method of claim 1, wherein the nearest restraining roll is a cradle roll on which the metal coil is mounted.

3. The opening method of claim 1, wherein the plate thickness of the metal sheet is 4.5 mm or greater.

4. The opening method of claim 2, wherein the opening blade body swings about an axis parallel to the cradle roll so as to approach the outer peripheral surface of the metal coil, or to move away from the outer peripheral surface of the metal coil.

5. The opening method of claim 4, wherein a path of a leading end of the opening blade body is orthogonal to the outer peripheral surface of the metal coil.

6. The opening method of claim 1, wherein the metal sheet is cut to obtain a test sample with the inner peripheral surface of the metal sheet supported by the opening blade body and the leading end of the metal sheet in a free state.

7. The opening method of claim 6, wherein a cutting process is performed by gas cutting, laser cutting, or plasma cutting.

8. The opening method of claim 7, wherein cutting of the metal sheet is performed with the opening blade body covered by a protector.

9. The opening method of claim 6, wherein the test sample obtained by cutting the leading end portion of the metal sheet separated from the outer peripheral surface of the metal coil using the opening blade body, is allowed to fall downward and is collected.

10. An opening device, comprising:

a cradle mechanism including a plurality of restraining rolls that rotatably restrain an outer peripheral surface of a metal coil of a wound metal sheet;

a drive section that drives the cradle mechanism so that the metal coil is rotated in a take-up direction or an opposite direction to the take-up direction;

a disposing mechanism that is configured to dispose an opening blade body such that a blade tip of the opening blade body is contacted onto an outer peripheral surface of the metal coil, when the metal coil is rotated in the opposite direction to the take-up direction of the metal coil by the cradle mechanism and the drive section, the blade tip is inserted inside the metal sheet from a leading end portion of the metal sheet to separate the leading end portion of the metal sheet from the metal coil using the opening blade body, and when rotation of the metal coil in the opposite direction is continued by the cradle mechanism and the drive section, an inner peripheral surface of the metal sheet is supported at a load action point of the metal sheet at which the inner peripheral surface of the metal sheet is supported by a supporting portion of the opening blade body using the opening blade body with the leading end portion of the metal sheet in a free state so as to satisfy the following Equation (1) and Equation (2); and a cutter that cuts the leading end portion of the metal sheet, to obtain a test sample, in a state in which the opening blade body is disposed such that the inner peripheral surface of the metal sheet is supported at the load action point of the metal sheet by the opening blade body so as to satisfy the following Equation (1) and Equation (2):

$$K = \frac{Yp \times Z}{2EI} R^2 (\Theta - \sin\Theta\cos\Theta) \quad \text{[Equation (1)]}$$

$$U \leq K \quad \text{[Equation (2)]}$$

wherein:

U is an opening radial direction dimension, from the load action point to the outer peripheral surface of the metal coil, in mm;

K is a radial direction permissible dimension at the load action point position, from an inner peripheral surface of the metal sheet to the outer peripheral surface of the metal coil, in mm;

Yp is a yield stress of the metal sheet, in kgf/mm$^2$;

Z is a section modulus of the metal sheet (=(⅙) bt$^2$), in mm$^3$, wherein b is a width of the metal sheet, in mm, and t is a plate thickness of the metal sheet, in mm;

R is a metal coil radius r from which one-half of the plate thickness t of the metal sheet has been subtracted (r −(½) t), in mm;

E is a Young's modulus of the metal sheet, in kgf/mm$^2$;

I is a second moment of area of the metal sheet, in mm$^4$; and

Θ is an angle in radians about an axis of the metal coil from the load action point to a portion restrained by a nearest restraining roll of the restraining rolls that is nearest to the load action point along a rewind direction of the metal coil.

11. The opening device of claim 10, wherein the nearest restraining roll is a cradle roll on which the metal coil is mounted.

12. The opening device of claim 11, further comprising a swing mechanism that swings the opening blade body about an axis parallel to the cradle roll such that the opening blade body is able to advance toward, or retreat from, the outer peripheral surface of the metal coil.

13. The opening device of claim 12, wherein the swing mechanism swings the opening blade body such that a path of the leading end of the opening blade body is orthogonal to the outer peripheral surface of the metal coil.

14. The opening device of claim 10, wherein the cutter is a gas cutter, a plasma cutter or a laser cutter.

15. The opening device of claim 14, further comprising a protector that covers at least an opposite side of the opening blade body to the metal coil.

16. The opening device of claim 10, further comprising a take-out mechanism that takes out the test sample that has been obtained by cutting the leading end portion of the metal sheet separated from the outer peripheral surface of the metal coil using the opening blade body, and that has fallen downward.

* * * * *